United States Patent [19]

Radice

[11] 4,178,816

[45] Dec. 18, 1979

[54] PORTABLE HYDRANT WRENCH

[76] Inventor: Robert Radice, 405 Oak Neck Rd., West Islip, Suffolk County, N.Y. 11795

[21] Appl. No.: 929,361

[22] Filed: Jul. 31, 1978

[51] Int. Cl.[2] ..... B25B 17/00

[52] U.S. Cl. ..... 81/57.3; 251/248

[58] Field of Search ..... 81/57.3; 251/248, 291

[56] References Cited

U.S. PATENT DOCUMENTS

| | | | |
|---|---|---|---|
| 1,265,144 | 5/1918 | Van Sickle | 81/57.3 |
| 2,527,288 | 10/1950 | Able et al. | 81/57.3 |
| 4,082,247 | 4/1978 | Dalton | 251/248 |

*Primary Examiner*—James L. Jones, Jr.
*Attorney, Agent, or Firm*—Stanley Ira Laughlin

[57] ABSTRACT

A portable hydrant wrench for use by one man comprising one or more drive bars having a rectangular cross-section and employing a detachable socket wrench at one of the free ends. A platform is secured to the hydrant to be serviced for positioning the drive bars in the center of the hydrant. Separate gear and drive assemblies attached to the free end of the drive bars opposite the detachable socket wrench provide the means of rotating the drive bars and therefore the socket wrench working the valves of the underground hydrant main pipe.

3 Claims, 7 Drawing Figures

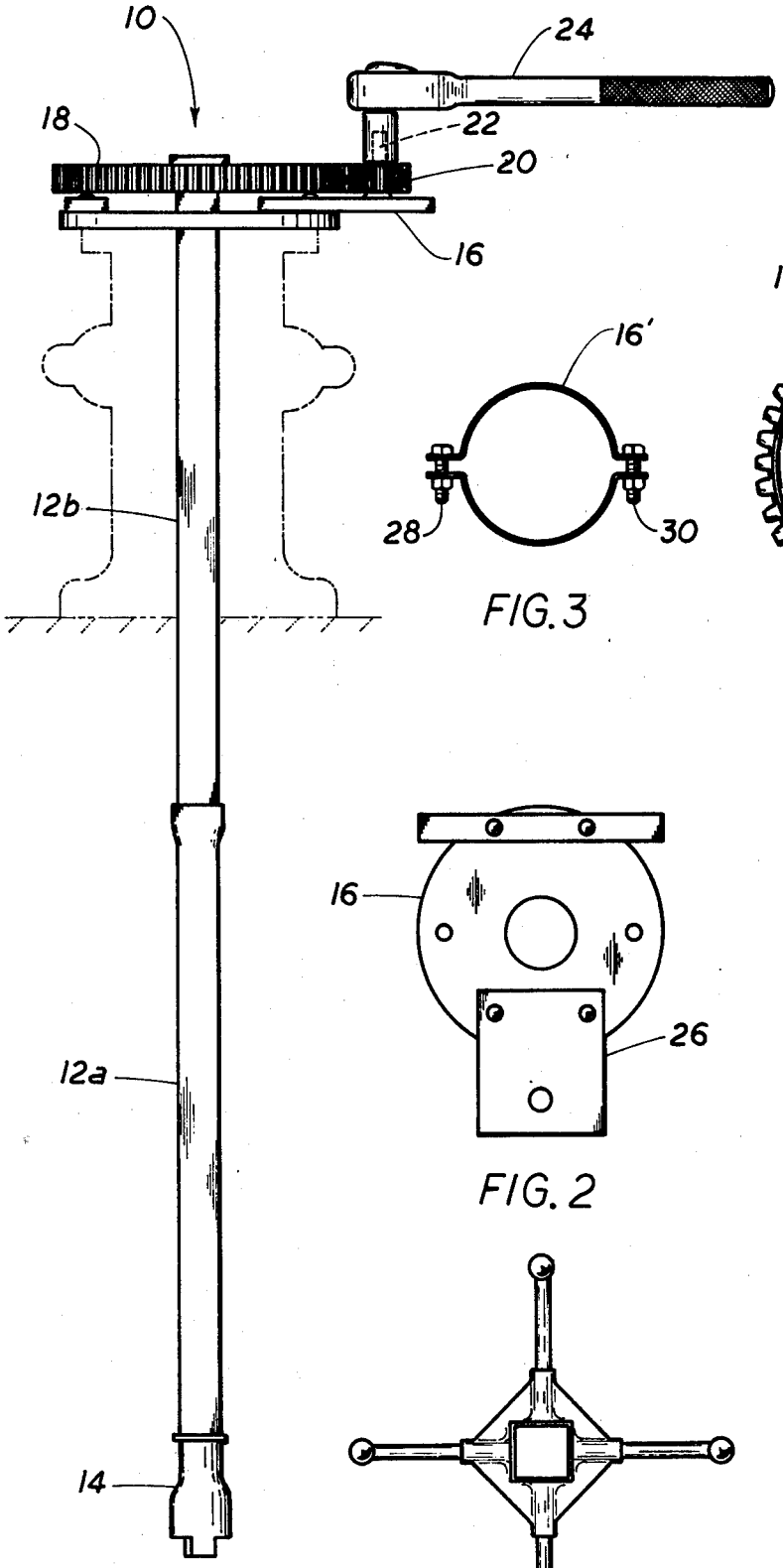
FIG. 1
FIG. 3
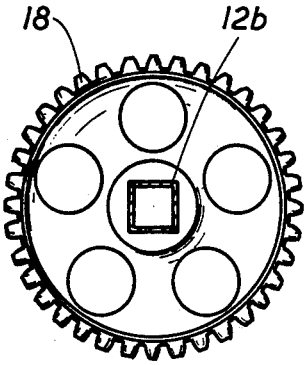
FIG. 4
FIG. 2
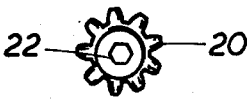
FIG. 5
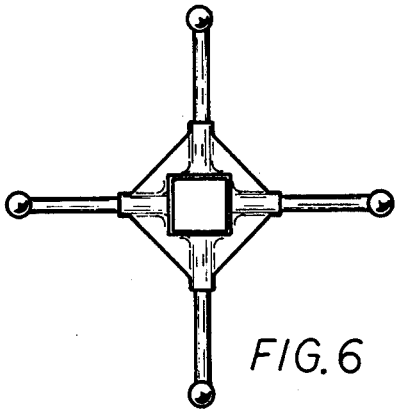
FIG. 6
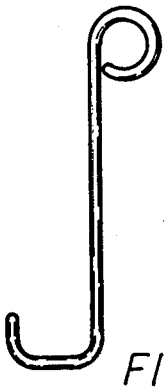
FIG. 7

PORTABLE HYDRANT WRENCH

BACKGROUND OF THE INVENTION

The invention relates to hydrant tools and more particularly valve actuators for use with valves buried underground such as taught in Class 251 subclasses 230, 291, 292, & 293 and Class 81 subclasses 56, 57, 58, 71, & 72.

U.S. Pat. No. 1,181,565 to Block describes a cylindrical rod having a keyway at one end for reaching shut-off valves buried in the ground.

U.S. Pat. No. 1,493,983 to Hurley describes a telescoping extension member employing pins to prevent rotation of the telescoping members within each other so that a wrench may be used to turn a nut at a location where it is impossible to use the wrench alone.

U.S. Pat. No. 1,806,556 to Green describes a tool employing a pair of tubes, one fitting within the other, and employing expandible jaws mounted at the bottom of the tubes for expansion within the pipe to be turned, thereby gripping the pipe so that it may be turned with the tool.

U.S. Pat. No. 1,815,755 to Armstrong describes apparatus for lubricating underground valves by employing a cylinder having a piston operated from the upper handle similar to a grease gun.

U.S. Pat. No. 2,088,785 to Gifford describes a tool employing a yoke having eccentric gripping jaws which may be turned to grip the inside of the pipe to be turned.

U.S. Pat. No. 3,768,775 to Archer describes a portable valve actuator which employs a yoke that is placed over the valve and engages the sides of the valve to enable the application of high torques to the valve and not the pipe.

It is an object of applicant's invention to provide a safe, simple and economical tool for operating and replacing underground hydrant main valves.

It is a further object of applicant's invention to provide a lightweight tool for operating and replacing underground hydrant main valves by only one workman.

It is yet a further object of applicant's invention to provide a tool for operating and replacing underground hydrant main valves that is easy to assemble and operate.

SUMMARY OF THE INVENTION

The invention relates to a light-weight, disassembled portable hydrant for the assembling of a tool for operating and removing valves in underground portions of hydrant pipes by a single workman. One or more rectangular drive bars provide the means for extending the interchangeable socket head that can be readily detached for mating with different types of valves. A positioning platform is secured to the hydrant and a separate gear assembly and a drive gear assembly are supported upon this platform for attachment to the rectangular drive bars, resulting in rotation of the socket head of the wrench.

BRIEF DESCRIPTION OF THE DRAWING

Applicant's invention will be more clearly understood by a reading of the Detailed Description with reference to the following drawings wherein FIG. 1 is a side elevation drawing of the hydrant wrench;

FIG. 2 is a top plan view of the base plate shown in FIG. 1;

FIG. 3 is a top plan view of an adaptor for the base plate shown in FIG. 2;

FIG. 4 is a top plan view of the gear assembly shown in FIG. 1;

FIG. 5 is a top plan view of the drive gear assembly shown in FIG. 1;

FIG. 6 is a top plan view of a manual turning device for the gear drives shown in FIGS. 4 & 5; and FIG. 7 is a side elevation view of a tool for removing parts of the hydrant wrench from the underground portion of the hydrant.

DETAILED DESCRIPTION

FIG. 1 shows an embodiment of applicant's inventive wrench 10 in position in an hydrant, shown in outline, comprising a plurality of rectangular cross-section drive bars **12*a* & 12*b*, a detachable socket head 14, interchangeable with other heads, for mating with a particular valve seated in the underground portion of the hydrant to be serviced, a hydrant base plate 16 providing a positioning platform for securing wrench 10 to a hydrant (shown in outline), a gear assembly 18 supported on the hydrant base plate 16 and providing means for attachment to the free end of the combination of drive bars 12*a* & 12*b*, and a drive gear assembly 20 for meshing with gear assembly 18 to drive the gear in gear assembly 18, ultimately driving drive bars 12*a* & 12*b*. FIG. 2 shows a top plan view of hydrant base plate 16 which provides the means for supporting gear assembly 18 as well as the means for positioning the drive bars 12*a* & 12*b* in the center of the hydrant (shown in outline). An appendage 26 to the hydrant base plate 16 provides the means for supporting drive gear assembly 20 so it is able to drive gear assembly 18. To facilitate easy rotation of wrench 10, the drive gear assembly, shown in detail in FIG. 5, employs a nut 22 which mates with a socket wrench 24 to rotate the gear in gear assembly 18, shown in detail in FIG. 4**.

In the event the hydrant is also damaged, such as frequently occurs when the hydrant is struck by a vehicle, a hydrant adaptor 16', shown in detail in FIG. 3, may be affixed to the broken hydrant by positioning the adaptor around the broken hydrant and securely fastening the adaptor to the hydrant by tightening screws 28 & 30. Hydrant base plate is then used as described in the foregoing paragraphs. In the event the hydrant is damaged to a degree that the hydrant base plate and adaptor 16' can not be used, a manual turning device, such as shown in FIG. 6, can be employed to remove the valve from its seat.

As can easily be seen, applicant's inventive wrench can be readily transported to a hydrant job site in its disassembled condition, and can be assembled for work by a single workman. As many drive bars as are required can be positioned within the hydrant to be serviced without any additional manpower. Having first attached the proper socket head, before conecting up the drive bars, the hydrant base plate, with or without adaptor 16' is then secured to the hydrant or part remaining. Finally, the gear and drive gear assemblies are connected up on hydrant base plate 16, and the entire wrench assembly 10 operated by rotating socket wrench 24. After the valve is operated, or a replacement made, the tool can be disassembled. Drive bars **12*a***

& 12*b* can easily be removed from the hydrant by means of a tool such as shown in FIG. 7, which is inserted into apertures (not shown) in the drive bars.

Although only one embodiment of applicant's invention has been illustrated, the scope and breadth of applicant's invention is to be limited only by the scope and breadth of the annexed claims.

I claim:

1. A portable hydrant wrench for assembly and use by a single workman to operate and replace valves located in underground portions of hydrants comprising one or more detachable drive bars having a rectangular cross-section, detachable heads for interchangeable mating with the different types of valves employed in the undergroundportion of hydrants, said heads being attached to the free end of said drive bars proximate to the valves in the underground portion of the hydrant, platform means secured to said hydrant to be serviced for positioning said drive bars within the center of said hydrant to be serviced, a gear assembly for connection to the free end of the combination of said drive bars opposite the free end having said detachable heads connected thereto, said gear assembly being positioned upon said platform means, and a drive gear assembly positioned upon said platform means in proximity to said gear assembly for cooperating with said gear assembly to rotate said hydrant wrench.

2. A portable hydrant wrench as claimed in claim 1 wherein said platform means comprises a base plate secured to the hydrant to be serviced.

3. A portable hydrant wrench as claimed in claim 2 wherein said base plate comprises an adaptor for securing said base plate to damaged hydrants.

* * * * *